US007641048B1

(12) United States Patent
Shih

(10) Patent No.: US 7,641,048 B1
(45) Date of Patent: Jan. 5, 2010

(54) TOOLBOX ASSEMBLY

(76) Inventor: Tsai-Chien Shih, No.18, Gongye 17th Rd., Taiping City, Taichung County (TW)

( * ) Notice: Subject to any disclaimer, the term of this patent is extended or adjusted under 35 U.S.C. 154(b) by 0 days.

(21) Appl. No.: 12/327,782

(22) Filed: Dec. 3, 2008

(51) Int. Cl.
*B65D 85/28* (2006.01)

(52) U.S. Cl. ..... 206/372; 220/646

(58) Field of Classification Search ..... 206/372, 206/373, 379, 349; 220/62.11, 626, 639, 220/645, 646
See application file for complete search history.

(56) References Cited

U.S. PATENT DOCUMENTS 6,367,628 B2 * 4/2002 Hu ..... 206/377
7,059,472 B2 * 6/2006 Lai ..... 206/372
2004/0134818 A1 * 7/2004 Cunningham et al. ..... 206/373
2004/0144671 A1 * 7/2004 Hallee et al. ..... 206/373

* cited by examiner

*Primary Examiner*—Jacob K Ackun, Jr.

(57) ABSTRACT

A toolbox assembly includes a toolbox casing and at least one auxiliary plate. The toolbox casing has at least one surface recess including a mounting segment defined in a front face and a fixing segment defined in a side face. The mounting segment has at least one slot. The at least one auxiliary plate has a first portion corresponding to the mounting segment and a second portion corresponding to the fixing segment. The first portion has at least one flange extended from an outer peripheral thereof and corresponding to the at least one slot. The at least one flange engages with the at least one slot. The first and second portion respectively and tightly fit within the mounting and fixing segment for protecting the toolbox assembly.

6 Claims, 7 Drawing Sheets

TOOLBOX ASSEMBLY

BACKGROUND OF THE INVENTION

1. Field of the Invention

The present invention relates to a toolbox, and more particularly to a toolbox assembly that provides high strength structure and the effort of identification.

2. Description of Related Art

A conventional toolbox in accordance with the prior art comprises an upper casing and a lower casing pivotally connected to the upper casing. The upper casing has an opening defined in a front face thereof. A transparent cover is mounted in the opening for recognizing the tools in the toolbox. The conventional toolbox is the low strength structure because the opening decreases the strength. The toolbox always impacts during carriage and usage. The toolbox and the transparent cover break due to the impact force. The upper casing and the lower casing are made of plastic to prevent from overweighting. However the tools are made of metal. Therefore the sufficient strength of the toolbox is needed for storage and protection.

The present invention has arisen to mitigate and/or obviate the disadvantages of the conventional toolbox.

SUMMARY OF THE INVENTION

The main objective of the present invention is to provide an improved toolbox assembly that provides high strength structure and the effort of identification.

To achieve the objective, the toolbox assembly includes a toolbox casing and at least one auxiliary plate connected to the toolbox casing. The toolbox casing has at least one surface recess defined therein. The at least one surface recess includes a mounting segment defined in a front face of the toolbox casing and a fixing segment defined in a side face of the toolbox casing. The mounting segment has at least one slot defined in an inner peripheral thereof. The at least one auxiliary plate has a first portion corresponding to the mounting segment and a second portion corresponding to the fixing segment. The first portion has at least one flange extended from an outer peripheral thereof and corresponding to the at least one slot. The at least one flange engages with the at least one slot. The first portion tightly fits within the mounting segment. The second portion tightly fits within the fixing segment.

Further benefits and advantages of the present invention will become apparent after a careful reading of the detailed description with appropriate reference to the accompanying drawings.

DETAILED DESCRIPTION OF THE INVENTION

Figure 1:
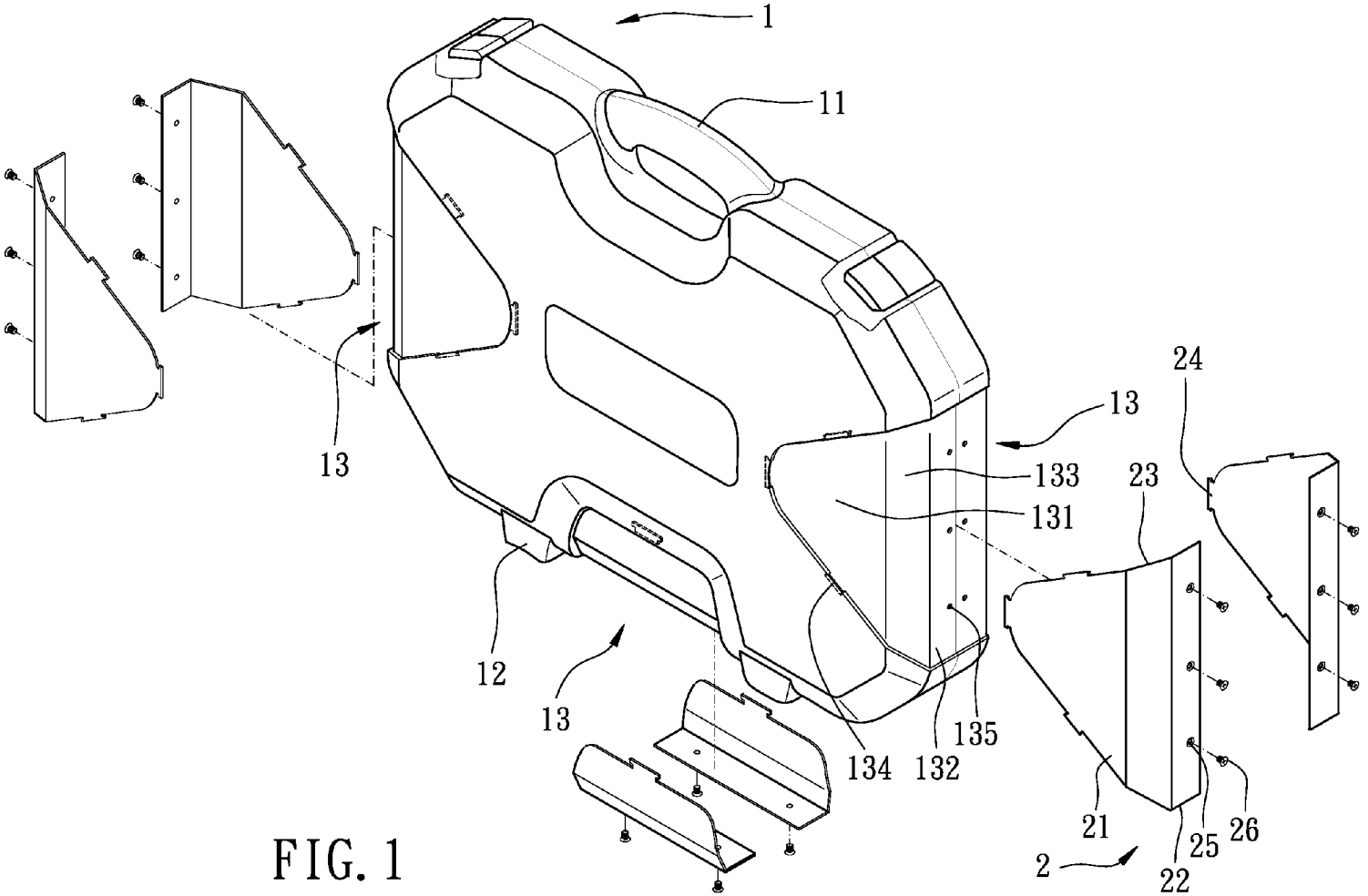
FIG. 1 is an exploded perspective view of a toolbox assembly in accordance with the present invention.
Figure 2:
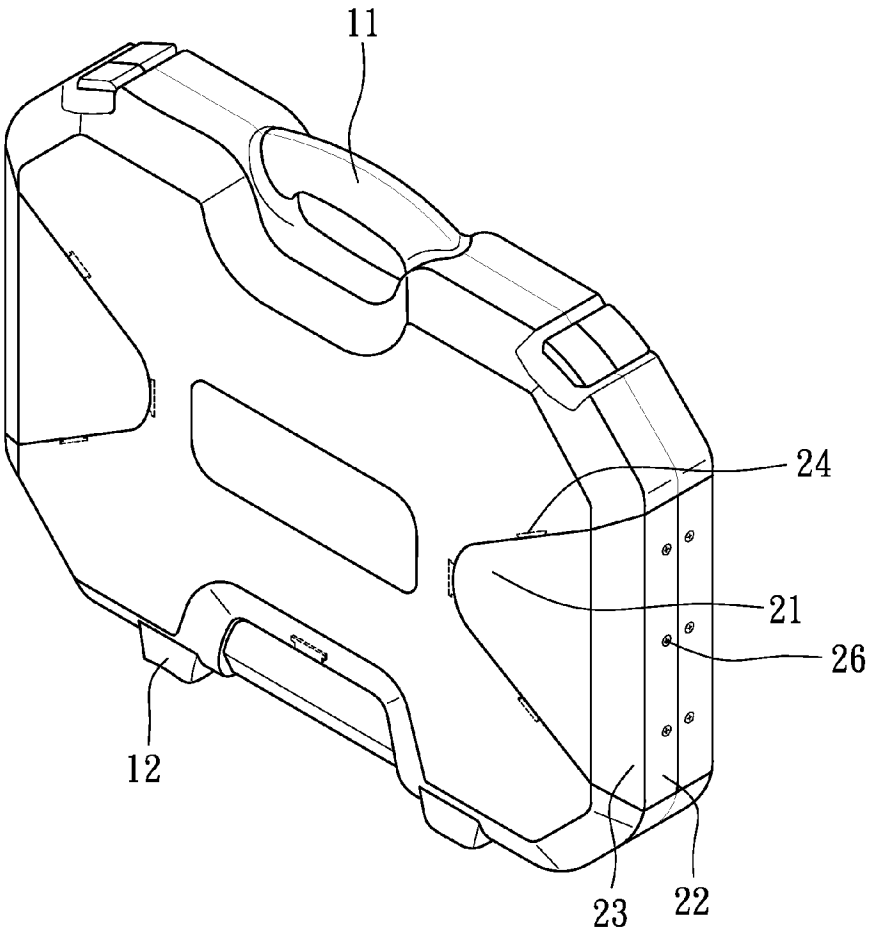
FIG. 2 is an assembled perspective view of the toolbox assembly in FIG. 1.

Referring to the drawings and initially to FIGS. 1 and 2, a toolbox assembly in accordance with the present invention comprises a toolbox casing 1 and at least one auxiliary plate 2 connected to the toolbox casing 1.

The toolbox casing 1 has a handle 11 formed on a top thereof for gripping by user. The toolbox casing 1 has two foot stand 12 formed on a bottom thereof such that the toolbox casing 1 stably stands on the ground. The toolbox casing 1 has at least one surface recess 13 defined in an outer surface thereof for receiving the at least one auxiliary plate 2. The at least one surface recess 13 includes a mounting segment 131, a fixing segment 132, and a linking segment 133 respectively defined therein. The mounting segment 131 is formed in a front face of the toolbox casing 1. The fixing segment 132 is formed in a side face of the toolbox casing 1, which is perpendicular to the front face of the toolbox casing 1. Therefore, the fixing segment 132 is substantially perpendicular to the mounting segment 131. The linking segment 133 is disposed between the mounting segment 131 and the fixing segment 132. The mounting segment 131 has at least one slot 134 defined in an inner peripheral thereof. The fixing segment 132 has at least one screw hole 135 defined in a bottom thereof.

The at least one auxiliary plate 2 is formed of sheet metal and made of steel. An outer surface of the at least one auxiliary plate 2 is coated by reflective material. The at least one auxiliary plate 2 is corresponded to the at least one surface recess 13. The at least one auxiliary plate 2 includes a first portion 21 corresponding to the mounting segment 131, a second portion 22 corresponding to the fixing segment 132, and a third portion 23 corresponding to the linking segment 133. Therefore, when the at least one auxiliary plate 2 is received in the corresponding surface recess 13, the at least one auxiliary plate 2 is concealed in the corresponding surface recess 13. The first portion 21 has at least one flange 24 extended from an outer peripheral thereof and corresponding to the at least one slot 134. The second portion 22 has at least one through hole 25 defined therein and corresponding to the at least one screw hole 135.

When assembling, the at least one flange 24 engages with the corresponding slot. At least one bolt 26 passes the at least one through hole 25 and screws into the at least one screw hole 135. The first portion 21 tightly fits within the mounting segment 131. The second portion 22 tightly fits within the fixing segment 132. The third portion 23 tightly fits within the linking segment 133.

Figure 3:
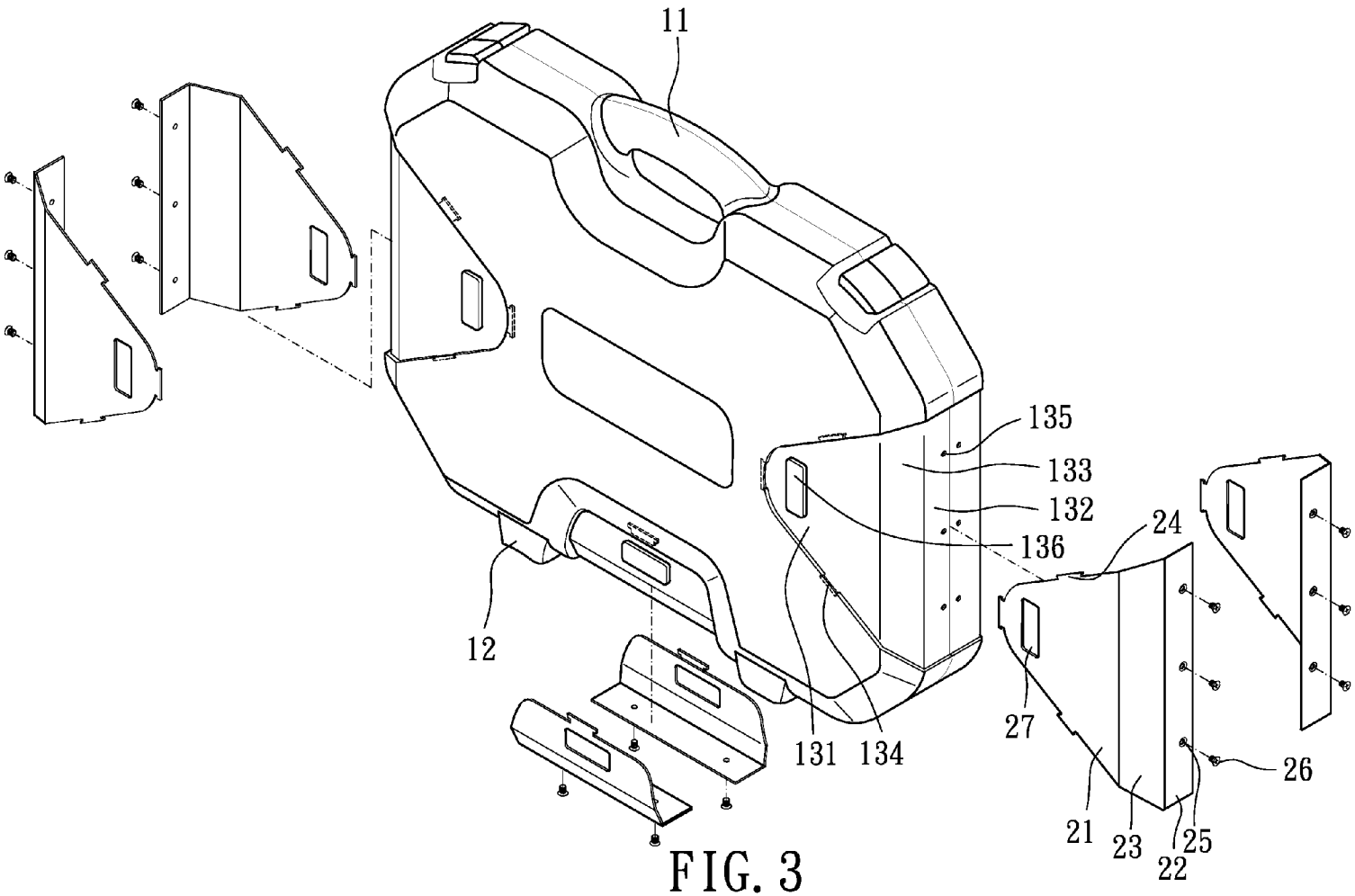
FIG. 3 is an exploded perspective view of a second embodiment of a toolbox assembly in accordance with the present invention.
Figure 4:
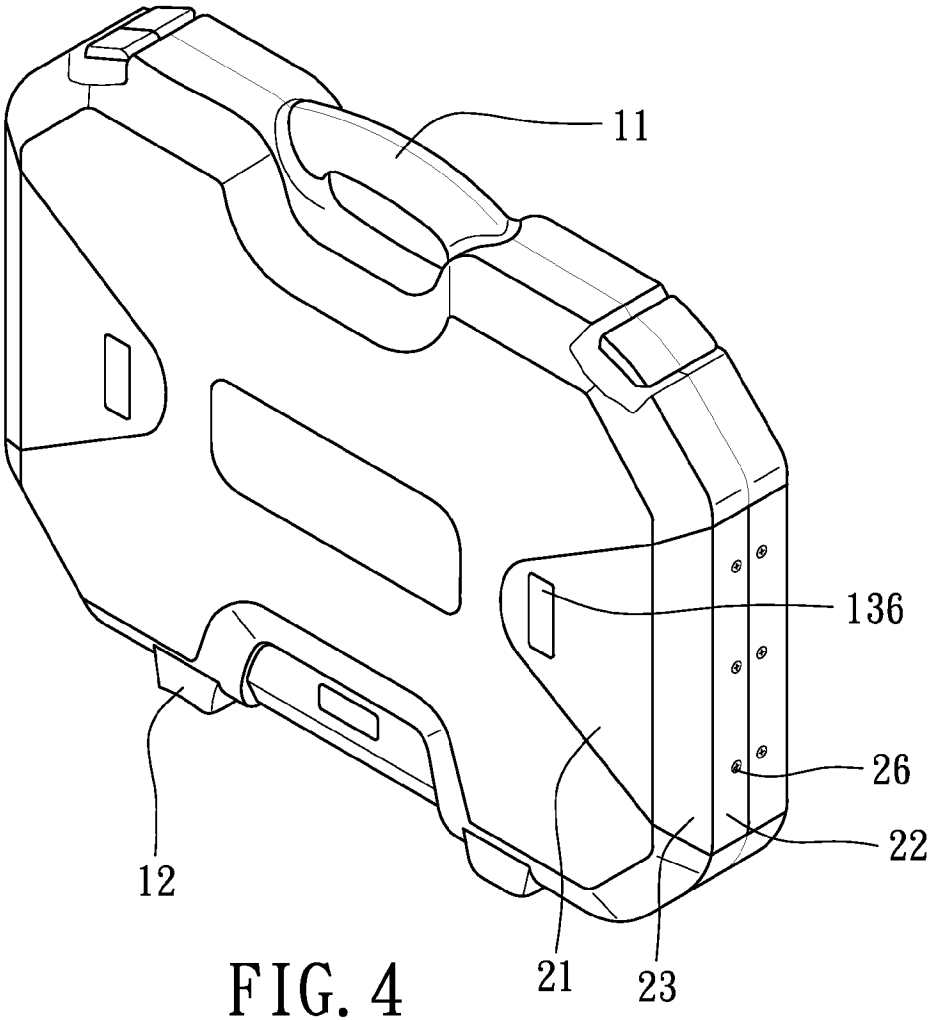
FIG. 4 is an assembled perspective view of the toolbox assembly in FIG. 3.

Referring to FIGS. 3 and 4, a second embodiment of a toolbox assembly in accordance with the present invention is illustrated. The elements and effects of the second embodiment which are the same with the first embodiment are not described, only the differences are described. The mounting segment 131 has a protrusion 136 extended from a bottom thereof for enhancing the strength of the toolbox casing 1. The first portion 21 has an opening 27 defined therein and corresponding to the protrusion 136. When assembling, the protrusion 136 engages with the opening 27 to increase the stability of connection between the toolbox casing 1 and the at least one auxiliary plate 2.

Figure 5:
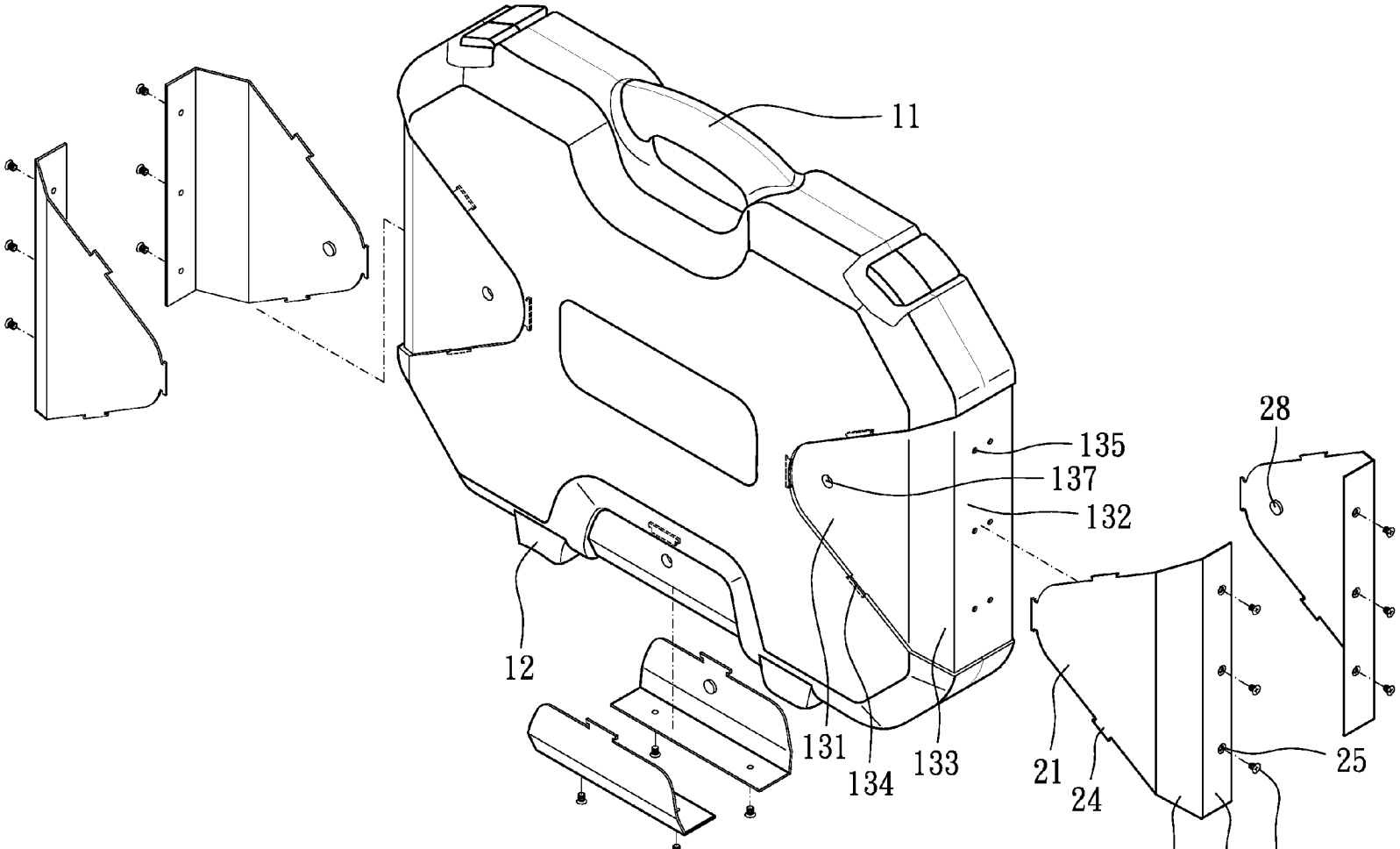
FIG. 5 is an exploded perspective view of a third embodiment of a toolbox assembly in accordance with the present invention.

Referring to FIG. 5, a third embodiment of a toolbox assembly in accordance with the present invention is illustrated. The elements and effects of the third embodiment which are the same with the first embodiment are not described, only the differences are described. The mounting segment 131 has a hole 137 defined in a bottom thereof. The first portion 21 has a stub 28 extended therefrom and corresponding to the hole 137. When assembling, the stub 28 engages with the hole 137 to increase the stability of connection between the toolbox casing 1 and the at least one auxiliary plate 2.

Figure 6:
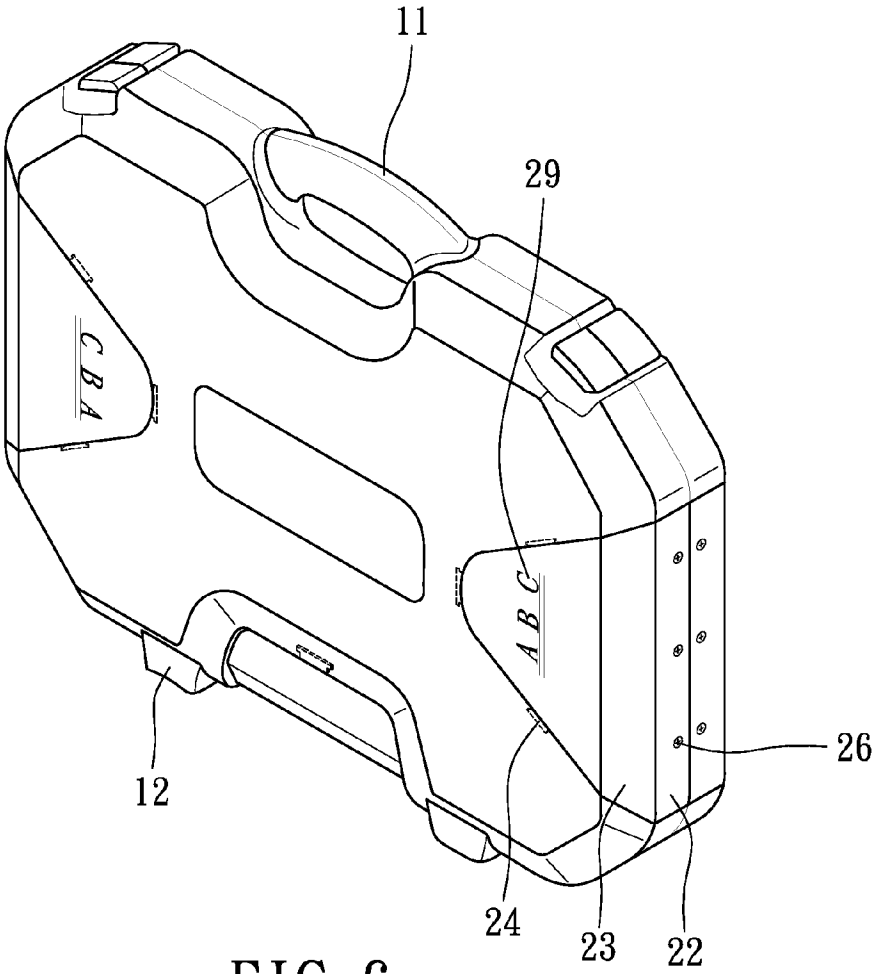
FIG. 6 is a perspective view of a fourth embodiment of a toolbox assembly in accordance with the present invention.

Referring to FIG. 6, a fourth embodiment of a toolbox assembly in accordance with the present invention is illustrated. The elements and effects of the fourth embodiment which are the same with the first embodiment are not described, only the differences are described. The at least one auxiliary plate 2 has an indication 29 marked on an outer surface thereof for identifying the toolbox assembly. The at least one auxiliary plate 2 is provided not only to protect the toolbox casing 1 but also to mark the toolbox assembly.

Figure 7:
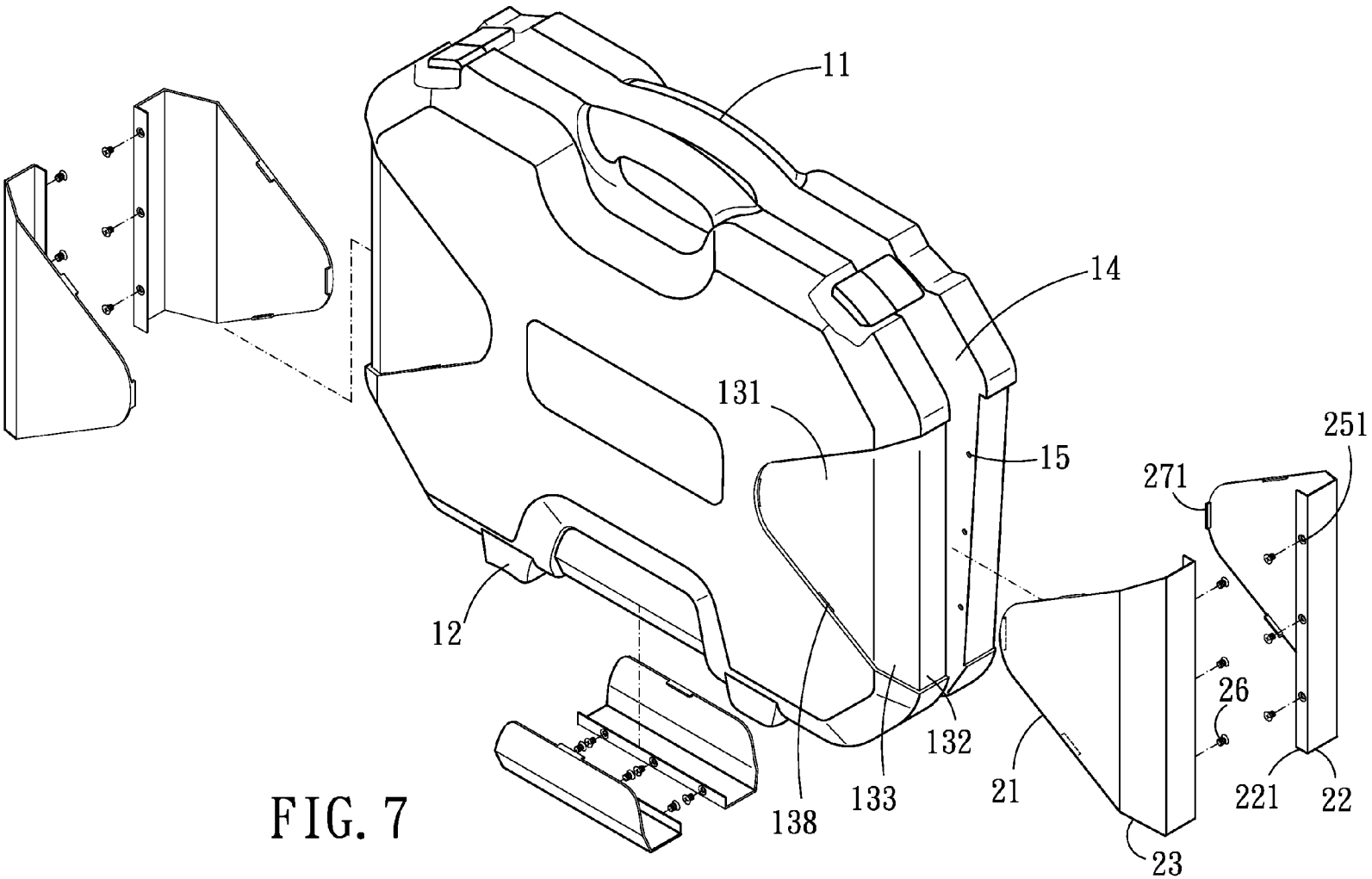
FIG. 7 is an exploded perspective view of a fifth embodiment of a toolbox assembly in accordance with the present invention.

Referring to FIG. 7, a fifth embodiment of a toolbox assembly in accordance with the present invention is illustrated. The elements and effects of the fifth embodiment which are the same with the first embodiment are not described, only the differences are described. The toolbox casing 1 has two inner faces 14. Each inner face 14 is perpendicular to the fixing segment 132. Each inner face 14 has at least one screw hole 15 defined therein. The mounting segment 131 has at least one slot 138 defined in a bottom thereof and formed along an edge thereof. The at least one auxiliary plate 2 has a fourth portion 221 perpendicularly extended from the second portion 22 thereof. The fourth portion 221 has at least one through hole 251 defined therein and corresponding to the at least one screw hole 15. The first portion 21 has at least one flange 271 perpendicular extended from an edge thereof and corresponding to the at least one slot 138. When assembling, the at least one flange 271 engages with the corresponding slot 138. The fourth portion 221 abuts against the inner face 14. The at least one bolt 26 passes the at least one through hole 251 and screws into the at least one screw hole 15.

Although the invention has been explained in relation to its preferred embodiment, it is to be understood that many other possible modifications and variations can be made without departing from the spirit and scope of the invention as hereinafter claimed.

What is claimed is:

1. A toolbox assembly comprising:

a toolbox casing having at least one surface recess defined therein, the at least one surface recess including a mounting segment defined in a front face of the toolbox casing, a fixing segment defined in a side face of the toolbox casing, and a linking segment disposed between the mounting segment and the fixing segment, the mounting segment having at least one slot defined in an inner peripheral thereof and a protrusion extended from a bottom thereof, the fixing segment having at least one screw hole defined therein;

at least one auxiliary plate connected to the toolbox casing, the at least one auxiliary plate having a first portion corresponding to the mounting segment, a second portion corresponding to the fixing segment, and a third portion corresponding to the linking segment, the first portion having at least one flange extended from an outer peripheral thereof and corresponding to the at least one slot, the first portion having an opening defined therein and corresponding to the protrusion, the second portion having at least one through hole defined therein and corresponding to the at least one screw hole; and at least one bolt connected to the at least one auxiliary plate, wherein the at least one bolt passes the at least one through hole in the second portion and screws into the at least one screw hole on the fixing segment;

wherein the at least one flange engages with the at least one slot; the protrusion engages with the opening when assembling to increase the stability of connection between the toolbox casing and the at least one auxiliary plate; the first portion tightly fits within the mounting segment; the second portion tightly fits within the fixing segment; the third portion tightly fits within the linking segment.

2. The toolbox assembly as claimed in claim 1, wherein the at least one auxiliary plate is formed of sheet metal and made of steel; an outer surface of the at least one auxiliary plate is coated by reflective material.

3. The toolbox assembly as claimed in claim 1, wherein the at least one auxiliary plate has an indication marked on an outer surface thereof for identifying the toolbox assembly.

4. A toolbox assembly comprising:

a toolbox casing having at least one surface recess defined therein, the at least one surface recess including a mounting segment defined in a front face of the toolbox casing, a fixing segment defined in a side face of the toolbox casing, and a linking segment disposed between the mounting segment and the fixing segment, the mounting segment having at least one slot defined in an inner peripheral and a hole in a bottom thereof; the fixing segment having at least one screw hole defined therein;

at least one auxiliary plate connected to the toolbox casing, the at least one auxiliary plate having a first portion corresponding to the mounting segment, a second portion corresponding to the fixing segment, and a third portion corresponding to the linking segment, the first portion having at least one flange extended from an outer peripheral thereof and corresponding to the at least one slot, the first portion having a stub extended therefrom and corresponding to the hole, the second portion having at least one through hole defined therein and corresponding to the at least one screw hole; and at least one bolt connected to the at least one auxiliary plate, wherein the at least one bolt passes the at least one through hole in the second portion and screws into the at least one screw hole in the fixing segment;

wherein the at least one flange engages with the at least one slot; the stub engages with the hole to increase the stability of connection between the toolbox casing and the at least one auxiliary plate; the first portion tightly fits within the mounting segment; the second portion tightly fits within the fixing segment; the third portion tightly fits within the linking segment.

5. The toolbox assembly as claimed in claim 4, wherein the at least one auxiliary plate is formed of sheet metal and made of steel; an outer surface of the at least one auxiliary plate is coated by reflective material.

6. The toolbox assembly as claimed in claim 4, wherein the at least one auxiliary plate has an indication marked on an outer surface thereof for identifying the toolbox assembly.

* * * * *